US008525766B2

(12) United States Patent
Park et al.

(10) Patent No.: US 8,525,766 B2
(45) Date of Patent: Sep. 3, 2013

(54) METHOD OF DRIVING LIQUID CRYSTAL DISPLAY DEVICE USING ALTERNATING CURRENT VOLTAGES AS STORAGE CAPACITOR VOLTAGE

(75) Inventors: Cheol-Woo Park, Daegu (KR); Seung-Hak Kim, Kyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 842 days.

(21) Appl. No.: 12/003,624

(22) Filed: Dec. 28, 2007

(65) Prior Publication Data

US 2008/0204387 A1 Aug. 28, 2008

(30) Foreign Application Priority Data

Feb. 28, 2007 (KR) ..... 10-2007-0020483

(51) Int. Cl.
*G09G 3/36* (2006.01)

(52) U.S. Cl.
USPC ..... 345/94

(58) Field of Classification Search
USPC ..... 345/87–104
See application file for complete search history.

(56) References Cited

U.S. PATENT DOCUMENTS 5,289,174 A * 2/1994 Suzuki ..... 345/98
5,686,932 A * 11/1997 Tomita ..... 345/94
6,166,714 A * 12/2000 Kishimoto ..... 345/96
2004/0164942 A1 8/2004 Shih et al.
2008/0049052 A1* 2/2008 Akiyama ..... 345/694

FOREIGN PATENT DOCUMENTS

CN 1375734 A 10/2002
WO WO 2006035887 A1 * 4/2006

OTHER PUBLICATIONS

Office Action issued Nov. 27, 2009 in corresponding Chinese Application No. 2007103083542.

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

A method of driving a liquid crystal display device, which includes first and second substrates, gate lines on the first substrate, data lines crossing the gate lines to define pixel regions, a thin film transistor connected to each gate line and each data line, a common line between adjacent gate lines, a pixel electrode in each pixel region and overlapping the common line, and a common electrode on the second substrate, includes steps of sequentially applying scanning signals to the gate lines, applying data signals to the data lines to supply the pixel electrode with pixel voltage, applying a common voltage to the common electrode, and applying a storage capacitor voltage to the common line, wherein the pixel voltage and the storage capacitor voltage are alternating current (AC) voltages having positive and negative polarities alternately with respect to the common voltage.

12 Claims, 8 Drawing Sheets

METHOD OF DRIVING LIQUID CRYSTAL DISPLAY DEVICE USING ALTERNATING CURRENT VOLTAGES AS STORAGE CAPACITOR VOLTAGE

This application claims the benefit of Korean Patent Application No. 10-2007-0020483, filed on Feb. 28, 2007, which is hereby incorporated by reference for all purposes as if fully set forth herein.

BACKGROUND OF THE INVENTION

1. Field of the Invention

The present invention relates to a liquid crystal display device, and more particularly, to a method of driving a liquid crystal display device.

2. Discussion of the Related Art

Liquid crystal display (LCD) devices are driven based on optical anisotropy and polarization characteristics of a liquid crystal material. Liquid crystal molecules have a long and thin shape, and the liquid crystal molecules are regularly arranged along in an alignment direction. Light passes through the LCD device along the long and thin shape of the liquid crystal molecules. The alignment of the liquid crystal molecules depends on the intensity or the direction of an electric field applied to the liquid crystal molecules. By controlling the intensity or the direction of the electric field, the alignment of the liquid crystal molecules is controlled to display images.

A related art LCD device and a driving method of the same will be described with reference to the accompanying drawings.

FIG. 1 is an equivalent circuit diagram of a related art LCD device.

In FIG. 1, the related art LCD device includes gate lines G1 to Gn, data lines D1 to Dn, switching elements T, liquid crystal capacitors $C_{LC}$ and storage capacitors Cst. The gate lines G1 to Gn and the data lines D1 to Dn cross each other to define pixel regions P. The switching element T, the liquid crystal capacitor $C_{LC}$ and the storage capacitor Cst are disposed at each pixel region P. A capacitance of the liquid crystal capacitor $C_{LC}$ is defined by a potential difference between a pixel voltage and a common voltage applied to liquid crystal.

In the LCD device of FIG. 1, scanning signals are sequentially applied to the gate lines G1 to Gn with time intervals, and the switching elements T connected thereto turn on. According to this, data signals from the data lines D1 to Dn are input to pixels through the switching elements.

More particularly, the scanning signals are sequentially applied to a first gate line G1 to an nth gate line Gn. When the scanning signal is applied to the first gate line G1, switching elements T, gate electrodes of which are connected thereto, turn on. At this time, selected data signals flow through the data lines D1 to Dn, and selected pixels become on states.

Here, the scanning signals are applied for a short time. To maintain charged amounts of the liquid crystal capacitors $C_{LC}$ until next scanning signals are applied, capacitances of the storage capacitors Cst are used.

If voltages having the same polarities are continuously applied to liquid crystal capacitors $C_{LC}$, the liquid crystal of the liquid crystal capacitors $C_{LC}$ may be degraded to cause flickering or dimming of an image. According, to prevent the degradation of the liquid crystal and improve qualities of the image, the LCD device is driven by inversion driving methods, in which polarities of the liquid crystal capacitors $C_{LC}$ are regularly inversed.

The inversion driving methods include a frame inversion driving method, in which the polarities of the liquid crystal capacitors $C_{LC}$ are inversed every frame, a column inversion driving method, in which the polarities of the liquid crystal capacitors $C_{LC}$ are inversed every vertical line, a line inversion driving method, in which the polarities of the liquid crystal capacitors $C_{LC}$ are inversed every horizontal line, a dot inversion driving method, in which the polarities of the liquid crystal capacitors $C_{LC}$ are inversed every pixel region P, and so on.

FIG. 2 is a view of illustrating signals for explaining operation of an LCD device of FIG. 1 and shows a pixel voltage Vp and a common voltage Vcom. The LCD device may be driven by a dot inversion driving method.

In FIG. 2, the pixel voltage Vp and the common voltage Vcom are applied to the liquid crystal capacitor $C_{LC}$ of FIG. 1. The common voltage Vcom is a direct current (DC) voltage. The pixel voltage Vp is an alternating current (AC) voltage having positive and negative polarities alternately with respect to the common voltage Vcom.

In the dot inversion driving method, voltages having opposite polarities are applied to respective pixels adjacent to each other along horizontal and vertical directions. Further, the polarities are changed every frame. Accordingly, flickers are offset in the pixels adjacent to each other along the horizontal and vertical directions, the degradation of the liquid crystal can be prevented.

A structure of an array substrate for an LCD device according to the related art will be described hereinafter with reference to accompanying FIG. 3.

FIG. 3 is a cross-sectional view of schematically illustrating an array substrate for a twisted nematic (TN) LCD device according to the related art, which is driven with a normally white mode.

As shown in FIG. 3, the LCD device according to the related art includes a lower substrate 22 and an upper substrate 50, with a liquid crystal layer 14 is interposed between the lower substrate 22 and the upper substrate 50. Thin film transistors T, pixel electrodes 46, gate lines 13 and data lines 42 are formed on the lower substrate 22. A black matrix 52, red, green and blue color filters 54*a*, 54*b* and 54*c* and a common electrode 56 are formed on the upper substrate 50. The lower substrate 22 including the thin film transistors T, the pixel electrodes 46, the gate lines 13 and the data lines 42 may be referred to as an array substrate. The upper substrate 50 including the black matrix 52, the color filters 54*a*, 54*b* and 54*c*, and the common electrode 56 may be referred to as a color filter substrate.

The gate lines 13 and the data lines 42 cross each other to define pixel regions P. The thin film transistors T are disposed near respective crossings of the gate and data lines 13 and 42 and are arranged in a matrix.

Each pixel electrode 46 is disposed at each pixel region P and is formed of a transparent conductive material such as indium tin oxide (ITO) that has relatively high transmittance of light. The pixel electrodes 46 are connected to the thin film transistors T, respectively. The pixel electrodes 46 are also arranged in a matrix.

Each thin film transistor T includes a gate electrode 30, an active layer 34, and source and drain electrodes 36 and 38. The gate electrode 30 is connected to the gate line 13 and is supplied with pulse signals from the gate line 13. The source electrode 36 is connected to the data line 42 and is supplied with data signals from the data line 42. The data signals are provided to the pixel electrode 46 through the drain electrode 38 that is spaced apart from the source electrode 36 and that is connected to the pixel electrode 46. The active layer 34 is disposed between the gate electrode 30 and the source and drain electrodes 36 and 38.

In a TN LCD device, when voltages are not applied, liquid crystal molecules of the liquid crystal layer 14 are initially twisted with 90 degrees.

That is, the liquid crystal molecules adjacent to the upper substrate 50 have an angle of 90 degrees with respect to the liquid crystal molecules adjacent to the lower substrate 22, and the liquid crystal molecules therebetween are arranged with gradually decreasing changed.

First and second polarizers 62 and 64 are disposed at outer surfaces of the upper substrate 50 and the lower substrate 20, respectively. The first polarizer 62 has a light transmission axis perpendicular to a light transmission axis of the second polarizer 64. The light transmission axes of the first and second polarizers 62 and 64 are parallel to the liquid crystal molecules adjacent to the upper substrate 50 and the lower substrate 20, respectively.

In an off state when voltages are not applied, light from a backlight (not shown) passes through the second polarizer 64 and becomes linearly polarized light. The linearly polarized light is twisted with 90 degrees while passing through the liquid crystal layer 14 and transmits the first polarizer 62 to display white.

On the other hand, in an on state when voltages are applied, the liquid crystal molecules of the liquid crystal layer 14 are arranged perpendicularly to the upper and lower substrates 50 and 22.

Accordingly, light from the backlight passes the second polarizer 64 and the liquid crystal layer 14, but the light is blocked or absorbed by the first polarizer 62, the light transmission axis of which is perpendicular to that of the second polarizer 64, to thereby display black.

Meanwhile, in the LCD device of FIG. 3, an end portion of the pixel electrode 46 extends over the gate line 13, which is previously disposed, and the storage capacitor Cst includes the gate line 13 as a first electrode and the pixel electrode 46 overlapping the gate line 13 as a second electrode. At this time, it is importance to make the storage capacitor Cst have a enough capacitance.

However, in the LCD device, since the gate line 13 is used an electrode of the storage capacitor Cst, there may be signal delay of the gate line 13, and this lowers operation of the LCD device.

To solve the problem, another structure of an array substrate for an LCD device has been proposed, which further includes a storage line as the first electrode of the storage capacitor.

FIG. 4 is a plan view of an array substrate for an LCD device according to the related art.

In FIG. 4, gate lines 74 are formed on a substrate 70 along a first direction, and data lines 86 are formed along a second direction. The gate lines 74 and the data lines 86 cross each other to define pixel regions P.

A thin film transistor T is formed near by each crossing point of the gate and data lines 74 and 86. The thin film transistor T includes a gate electrode 72, an active layer 80, a source electrode 82 and a drain electrode 84. The gate electrode 72 is connected to the gate line 74 and receives scanning signals from the gate line 74. The active layer 80 is formed over the gate electrode 72. The source electrode 82 is connected to the data line 86 and receives image signals from the data line 86. The drain electrode 84 is spaced apart from the source electrode 82.

A common line is further formed. The common line includes a first portion 76*a*, a second portion 76*b*, a third portion 76*c*, a fourth portion 76*d*, and a fifth portion 76*e* corresponding to each pixel region P. The first portion 76*a* and the second portion 76*b* are parallel to the data line 86 and positioned at both sides of the data line 86, respectively, such that the data line 86 is disposed between the first and second portions 76*a* and 76*b*. The third portion 76*c* and the fourth portion 76*d* are parallel to the gate line 74 and cross the data line 86 in upper and lower areas of the pixel region P, respectively. The third and fourth portions 76*c* and 76*d* connect the first portion 76*a* and the second portion 76*b*. The fifth portion 76*e* connects the second portion 76*b* and another first portion 76*a*, i.e., a first portion of a next pixel region, across the pixel region P. The fifth portion 76*e* may be disposed near by the thin film transistor T. Therefore, the first portion 76*a*, the second portion 76*b* and the fifth portion 76*e* have one-united shape at each pixel region P.

A pixel electrode 88 is formed at each pixel region P and is connected to the drain electrode 84. The pixel electrode 88 overlaps the fifth portion 76*e* of the common line. The overlapped fifth portion 76*e* functions as a first electrode and the overlapped pixel electrode 88 functions as a second electrode to thereby form a storage capacitor. The pixel electrode 88 may partially overlap the first and second portions 76*a* and 76*b*.

FIG. 5 is a view of illustrating signals for explaining operation of an LCD device of FIG. 4 and shows a pixel voltage Vp and a common voltage Vcom.

In FIG. 5, the pixel voltage Vp is applied to the pixel electrode 88, and the common voltage Vcom is applied to a common electrode (not shown), which is formed on a substrate opposite to the array substrate of FIG. 4. A storage capacitor voltage Vstg, which is applied to the common line 76*a*, 76*b*, 76*c*, 76*d* and 76*e* of FIG. 4, has the same value as the common voltage Vcom.

The thin film transistor T of FIG. 4 turns on by a scanning signal applied to the gate electrode 72 of FIG. 4, and the pixel voltage Vp is applied to the pixel electrode 88 of FIG. 4 through the thin film transistor T from the data line 86 of FIG. 4. The pixel voltage Vp alternates with respect to the common voltage Vcom.

By the way, in manufacturing the LCD device, there may be problems that the common line 76*a*, 76*b*, 76*c*, 76*d* and 76*e* and the pixel electrode 88 may short-circuit and particles may exist on a surface of a channel of the thin film transistor T. When a normally white mode LCD device displays black, pixels having the problems are shown white. Accordingly, these problems cause bright defects on a black image.

More detail explanation will be followed with reference to accompanying FIG. 6.

FIG. 6 is a cross-sectional view of an LCD device according to the related art and corresponds to the line VI-VI of FIG. 4.

In FIG. 6, the LCD device according to the related art includes a lower substrate 70 and an upper substrate 90, with a liquid crystal layer 98 is interposed between the lower substrate 70 and the upper substrate 90. Thin film transistors (not shown), pixel electrodes 88, gate lines (not shown), and data lines 86 are formed on the lower substrate 70. A black matrix 92, red, green and blue color filters 94*a*, 94*b* and 94*c* and a common electrode 96 are formed on the upper substrate 90.

As stated before, a common line is further formed on the lower substrate 70. The common line includes a first portion 76*a*, a second portion 76*b*, a third portion 76*c* of FIG. 4, a fourth portion 76*d* of FIG. 4, and a fifth portion 76*e* of FIG. 4 corresponding to each pixel region P. The pixel electrode 88 overlaps the fifth portion 76*e* of FIG. 4 to form a storage capacitor. The pixel electrode 88 also overlaps the first and second portions 76*a* and 76*b*.

By the way, during a fabrication process, the pixel electrode 88 may short-circuit with the second portion 76*b* of the common line as shown in an area F of FIG. 6. Although shown in the figure, the pixel electrode 88 may short-circuit with the first portion 76*a* of the common line.

At this time, since the pixel electrode 88 is influenced by a storage capacitor voltage of the common line, the same voltage as the common electrode 96 is applied to the pixel electrode 88 to thereby transmit light. Accordingly, there exist bright defects on a black image when voltages are applied.

In addition, although not shown in the figure, there may be particles on a surface of a channel of the thin film transistor. At this time, the thin film transistor including particles should be separated, and the pixel corresponding to the thin film transistor results in a bright defect on the black image.

Recently, zero defects have been highly required, and it is essential to zero bright defects in the LCD device.

By the way, as mentioned above, since the TN LCD device is driven with the normally white mode, it is difficult to minimize the bright defects. Furthermore, low cell gap has been demanded due to needs of fast response, and the short circuit between electrodes causes loss of productivity.

SUMMARY OF THE INVENTION

Accordingly, embodiments of the present invention are directed to a method of driving a liquid crystal display device that substantially obviates one or more problem due to limitations and disadvantages of the related art.

An advantage of embodiments of the invention is to provide a method of driving a liquid crystal display device that solves bright defects on a black image.

Another advantage is to provide a method of driving a liquid crystal display device that improves image qualities and productivity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display device, which includes first and second substrates, gate lines on the first substrate, data lines crossing the gate lines to define pixel regions, a thin film transistor connected to each gate line and each data line, a common line between adjacent gate lines, a pixel electrode in each pixel region and overlapping the common line, and a common electrode on the second substrate, includes steps of sequentially applying scanning signals to the gate lines, applying data signals to the data lines to supply the pixel electrode with pixel voltage, applying a common voltage to the common electrode, and applying a storage capacitor voltage to the common line, wherein the pixel voltage and the storage capacitor voltage are alternating current (AC) voltages having positive and negative polarities alternately with respect to the common voltage.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention.

In the drawings.

DETAILED DESCRIPTION OF THE ILLUSTRATED EMBODIMENTS

Reference will now be made in detail to an embodiment of the present invention, an example of which is illustrated in the accompanying drawings.

In a normally white mode TN LCD device of the present invention, an alternating current (AC) voltage is applied to a common line, which is formed on an array substrate. Accordingly, a pixel having a pixel electrode short-circuited with a common line becomes a dart defect.

Figure 7:
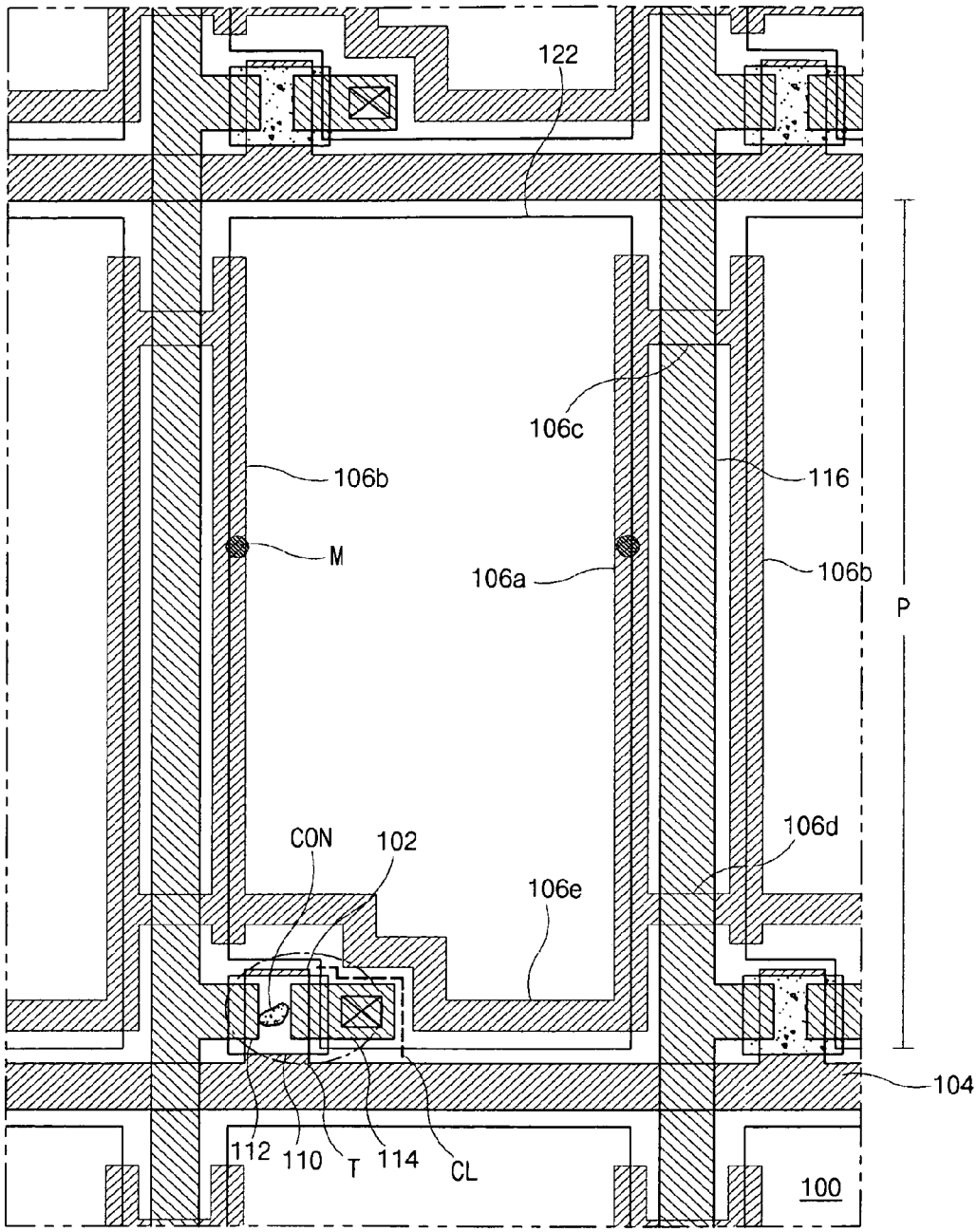
FIG. 7 is a plan view of an array substrate for an LCD device according to the present invention.

FIG. 7 is a plan view of an array substrate for an LCD device according to the present invention.

In FIG. 7, gate lines 104 are formed on a substrate 100 along a first direction, and data lines 116 are formed along a second direction. The gate lines 104 and the data lines 116 cross each other to define pixel regions P.

A thin film transistor T is formed near by each crossing point of the gate and data lines 104 and 116. The thin film transistor T includes a gate electrode 102, an active layer 110, ohmic contact layers (not shown), a source electrode 112 and a drain electrode 114. The gate electrode 102 is connected to the gate line 104 and receives scanning signals from the gate line 104. The active layer 110 and the ohmic contact layers overlap the gate electrode 102. The source electrode 112 and the drain electrode 114 are formed over the ohmic contact layers. The source electrode 112 is connected to the data line 116 and receives image signals from the data line 116. The drain electrode 114 is spaced apart from the source electrode 112.

A common line is further formed between adjacent gate lines 104. The common line includes a first portion 106*a*, a second portion 106*b*, a third portion 106*c*, a fourth portion 106*d*, and a fifth portion 106*e* corresponding to each pixel region P. The first portion 106*a* and the second portion 106*b* are parallel to the data line 116 and positioned at both sides of the data line 116 such that the data line 116 is disposed between the first and second portions 106*a* and 106*b*. The third portion 106*c* and the fourth portion 106*d* are parallel to the gate line 104 and cross the data line 116 in upper and lower areas of the pixel region P in the context of the figure, respectively. The third and fourth portions 106*c* and 106*d* connect the first portion 106*a* and the second portion 106*b*. The fifth portion 106*e* crosses the pixel region P along the first direction and connects the second portion 106*b* and another first portion 106*a*, i.e., a first portion of a next pixel region P. The fifth portion 106*e* may be disposed near by the thin film transistor T.

A pixel electrode 122 is formed at each pixel region P. The pixel electrode 122 is connected to the drain electrode 114. The pixel electrode 122 overlaps the fifth portion 106*e* of the common line.

Operation of an LCD device including the array substrate will be explained with reference to accompanying FIGS. 8A to 8C.

Figure 8A:
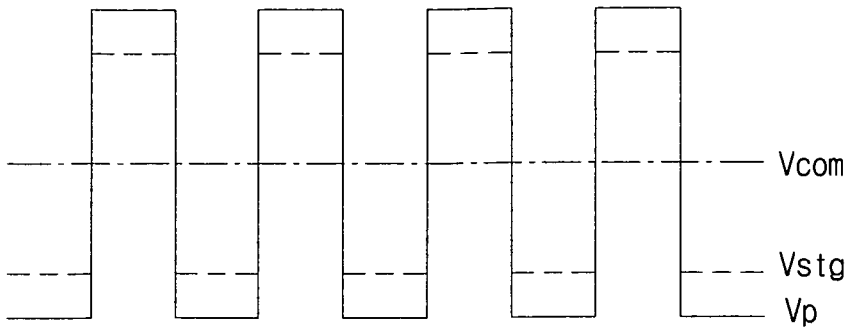
FIGS. 8A to 8C are views of illustrating signals for explaining operation of an LCD device of FIG. 7.
Figure 8B:
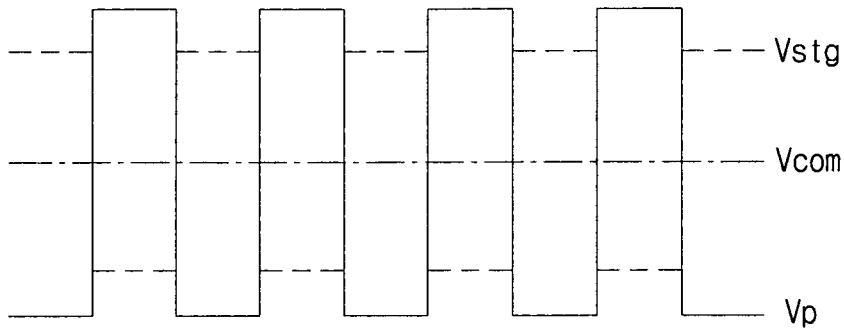
Figure 8C:
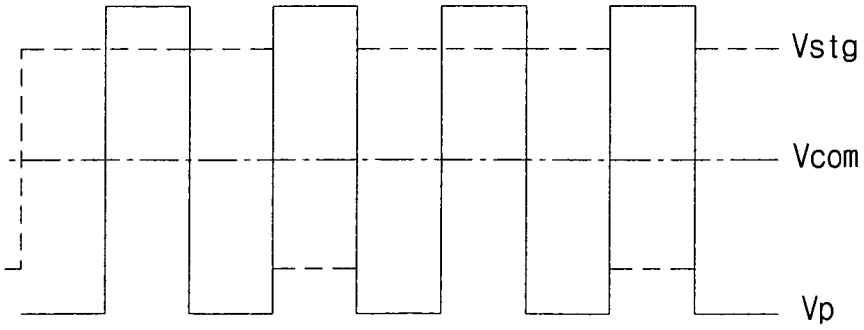

FIGS. 8A to 8C are views of illustrating signals for explaining operation of an LCD device of FIG. 7 and show a pixel voltage Vp, a common voltage Vcom and a storage capacitor voltage Vstg. The LCD device may be driven with a normally white mode.

More particularly, when a scanning signal is applied to the gate line 104, the thin film transistor T connected thereto turns on. An image signal, that is, the pixel voltage Vp is applied to the pixel electrode 122 through the thin film transistor T from the data line 116.

The pixel voltage Vp is an AC voltage changing from a positive polarity to a negative polarity or from a negative polarity to a positive polarity when a frame is changed. The LCD device may be driven by a dot inversion, column inversion, line inversion or frame inversion driving method.

At this time, a common voltage Vcom is applied to a common electrode (not shown), which is formed on a substrate opposite to the array substrate, and the storage capacitor voltage Vstg is applied to the common line 106*a*, 106*b*, 106*c*, 106*d* and 106*e* of FIG. 7.

The storage capacitor voltage Vstg is an AC voltage and is not the same as the common voltage Vcom. The storage capacitor voltage Vstg is applied by another power source differently from the related art.

The storage capacitor voltage Vstg may have the same period and the same polarity as the pixel voltage Vp as shown in FIG. 8A. The storage capacitor voltage Vstg may have the same period as and an opposite polarity to the pixel voltage Vp as shown in FIG. 8B. The storage capacitor voltage Vstg may have a different period from the pixel voltage Vp as shown in FIG. 8C.

Figure 1:
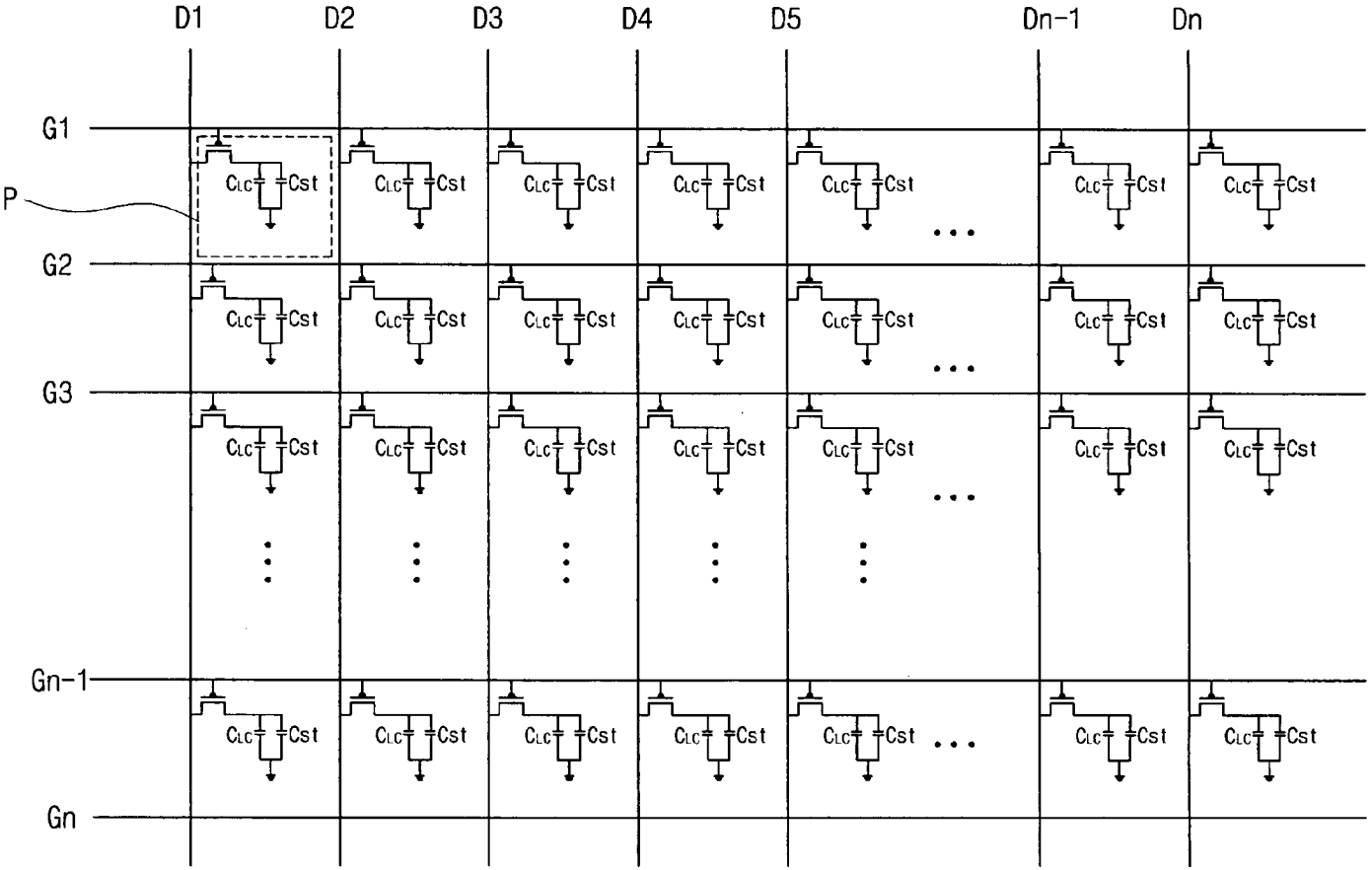
FIG. 1 RELATED ART
FIG. 1 is an equivalent circuit diagram of a related art LCD device.
Figure 2:
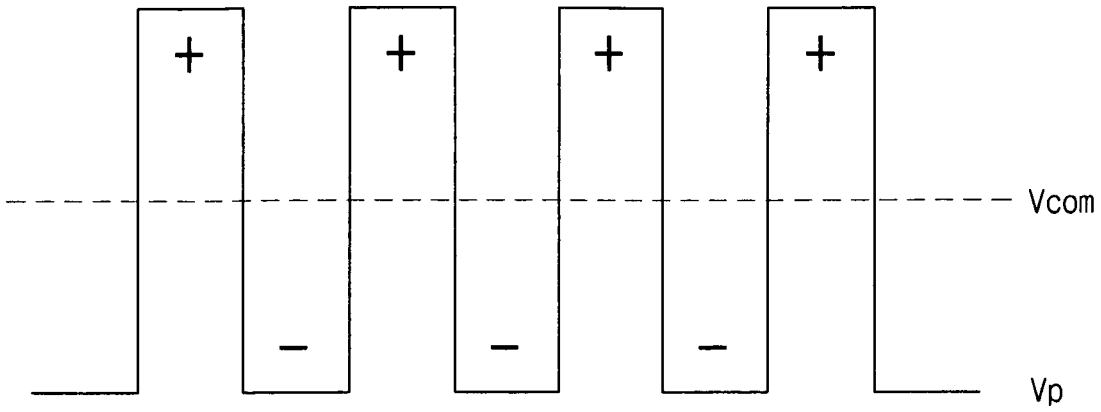
FIG. 2 RELATED ART
FIG. 2 is a view of illustrating signals for explaining operation of an LCD device of FIG. 1.
Figure 3:
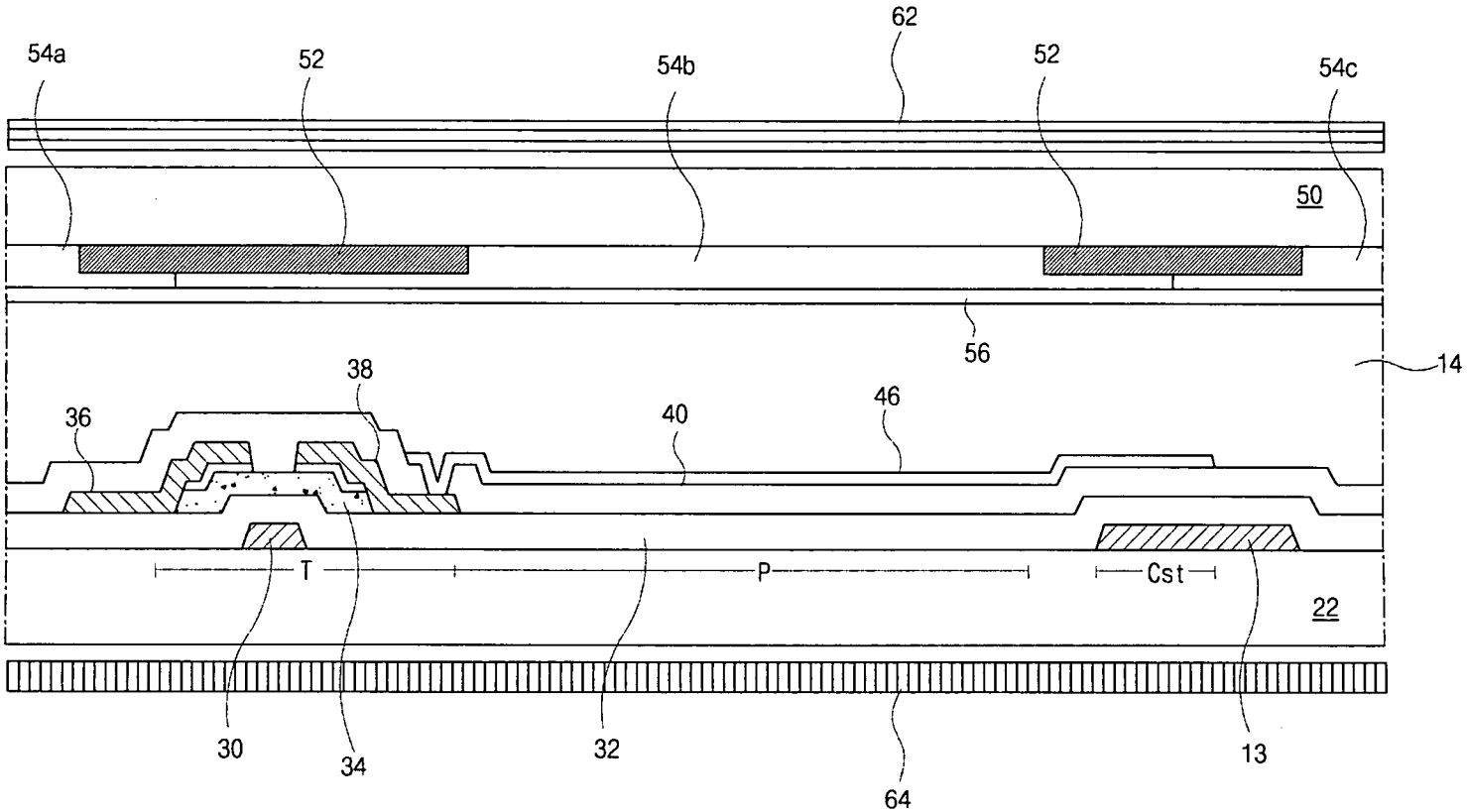
FIG. 3 RELATED ART
FIG. 3 is a cross-sectional view of schematically illustrating an array substrate for a twisted nematic (TN) LCD device according to the related art, which is driven with a normally white mode.
Figure 4:
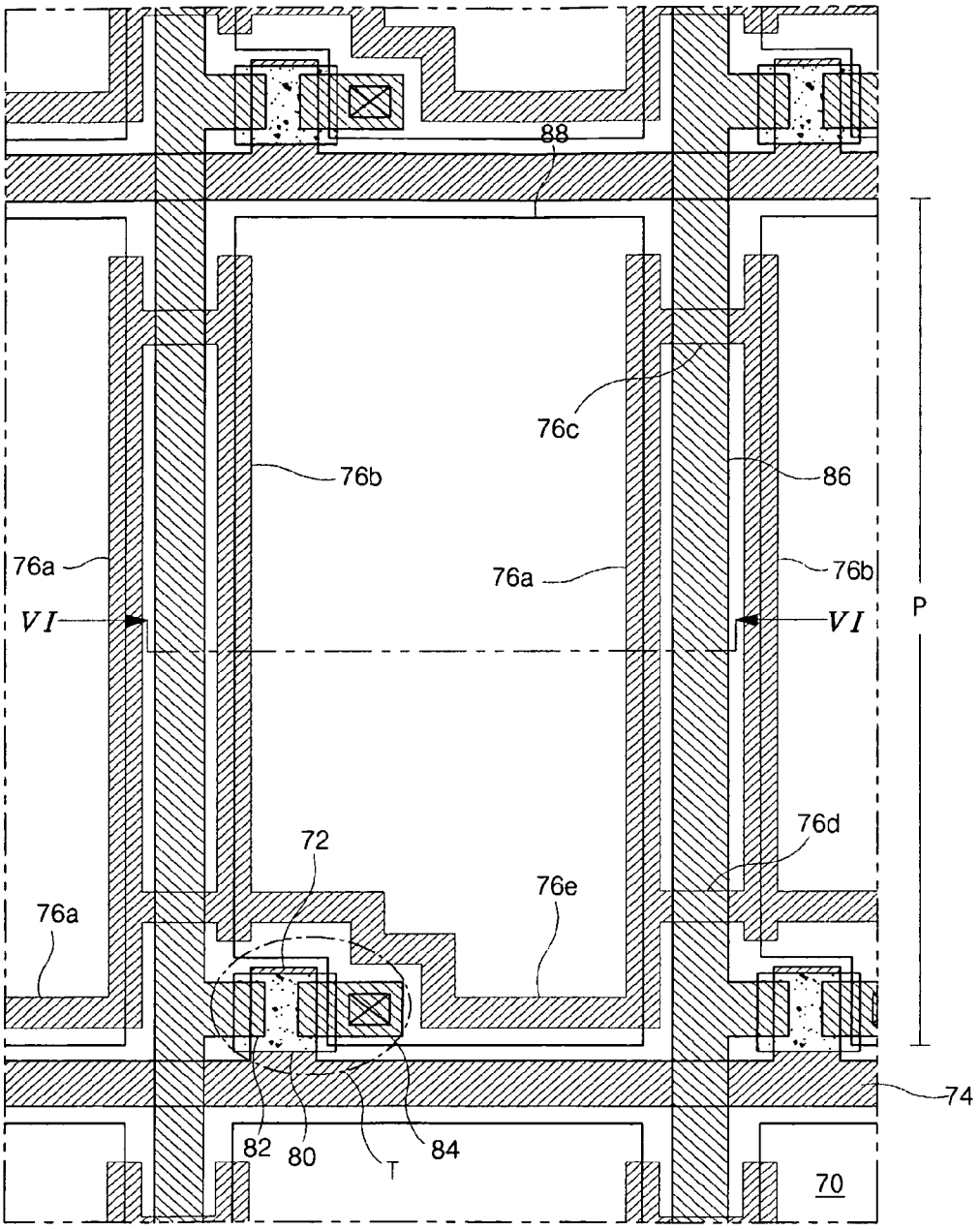
FIG. 4 RELATED ART
FIG. 4 is a plan view of an array substrate for an LCD device according to the related art.
Figure 5:
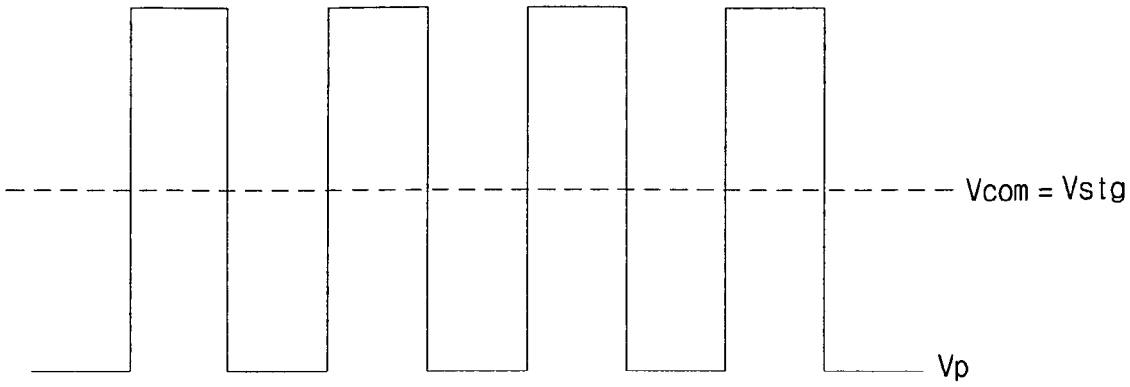
FIG. 5 RELATED ART
FIG. 5 is a view of illustrating signals for explaining operation of an LCD device of FIG. 4.
Figure 6:
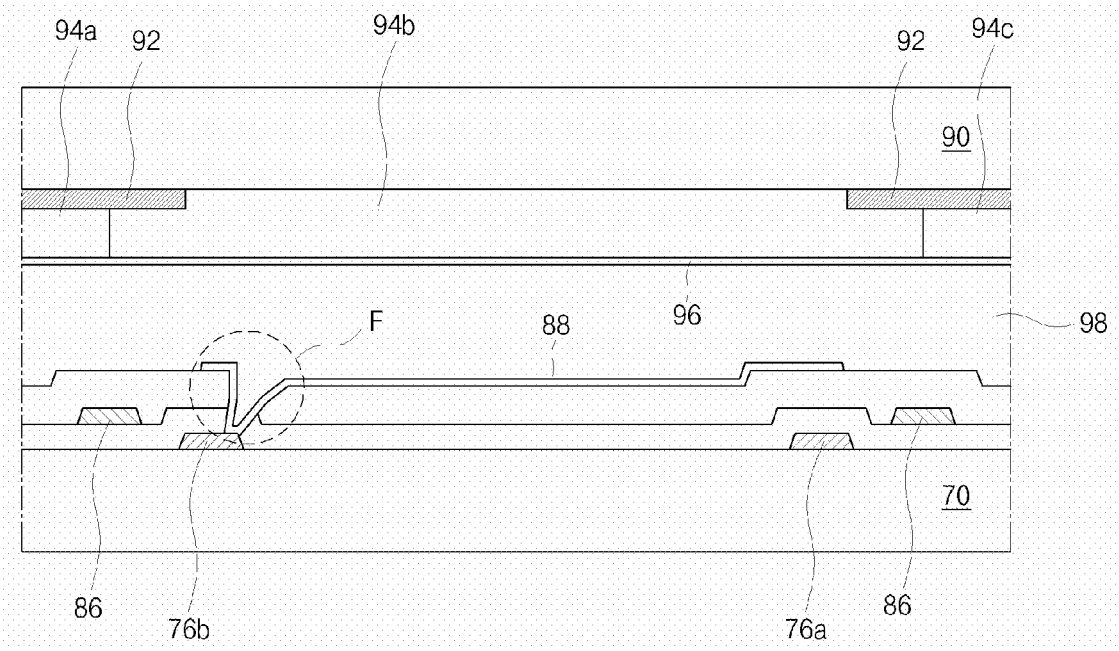
FIG. 6 RELATED ART
FIG. 6 is a cross-sectional view of an LCD device according to the related art and corresponds to the line VI-VI of FIG. 4.

In the LCD device, when voltages are applied and the LCD device displays a black image, normal pixels without defects accomplish black states by changing an arrangement of liquid crystal molecules by a difference between the pixel voltage Vp and the common voltage Vcom. On the other hand, an abnormal pixel, in which the pixel electrode 122 of FIG. 3 short-circuit with the common line 106*a*, 106*b*, 106*c*, 106*d* and 106*e* at a point M of FIG. 7, for example, attains a black state by changing an arrangement of the liquid crystal molecules by a difference between the storage capacitor voltage Vstg and the common voltage Vcom.

At this time, even though the abnormal pixel may have different black color purity from the normal pixel, the abnormal pixel becomes a dark defect not a bright defect on a black image. Therefore, there is no bright defect, and a contrast ratio of the LCD device is improved to achieve high qualities.

The above-mentioned driving method, in which an AC voltage is applied to the common line, is advantageous to solving a problem that the pixel electrode and the common line short-circuit.

Meanwhile, in a pixel, particles CON may exist on a channel of the thin film transistor T pixel as shown in FIG. 7. Or a line corresponding to the pixel region P may short-circuit with the pixel electrode 122. At this time, the thin film transistor T or a short-circuit portion may be separated from the pixel electrode 122 along the line CL, and the pixel electrode 122 may be welded with and connected to the common line 106*a*, 106*b*, 106*c*, 106*d* and 106*e*.

Then, in the pixel, liquid crystal molecules (not shown) are arranged by a difference between the common voltage Vcom and the storage capacitor voltage Vstg, and a black state is attained.

Like this, in the normally white mode LCD device according to the present invention, when a black image is displayed, abnormal pixels become black states by applying an AC voltage to the common line, and thus bright defects can be overcome.

According to this, the LCD device has high qualities.

Moreover, since an array substrate having the abnormal pixels is not disused and can be used for the LCD device, the productivity is increased.

It will be apparent to those skilled in the art that various modifications and variations can be made in the array substrate for a liquid crystal display device and a method of manufacturing the same of the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device, which includes first and second substrates, gate lines on the first substrate, data lines crossing the gate lines to define pixel regions, a thin film transistor connected to each gate line and each data line, common lines between adjacent gate lines and alternating the gate lines, a pixel electrode in each pixel region and overlapping one of the common lines, and a common electrode on the second substrate, the method comprising:

sequentially applying scanning signals to the gate lines;

applying data signals to the data lines to supply the pixel electrode with pixel voltage;

applying a common voltage to the common electrode; and applying a storage capacitor voltage to all the common lines, wherein the pixel voltage and the storage capacitor voltage are alternating current voltages having positive and negative polarities alternately with respect to the common voltage, wherein the storage capacitor voltage applied to one of the common lines has a same polarity as the storage capacitor voltage applied to another of the common lines next to the one of the common lines, wherein in one of the pixel regions, the pixel electrode short-circuits with a corresponding common line, and the storage capacitor voltage is applied to the short-circuited pixel electrode, and wherein the one of the pixel regions has different black color purity from others of the pixel regions when a black image is displayed and the one of the pixel regions becomes a dark defect, and wherein the pixel voltage is always higher than the storage capacitor voltage with respect to the common voltage when they both are in positive polarities and the pixel voltage is always lower than the storage capacitor voltage with respect to the common voltage when they both are in negative polarities.

2. The method according to claim 1, wherein the storage capacitor voltage has a same period and a same polarity as the pixel voltage.

3. The method according to claim 1, wherein each of the common lines includes first, second, third, fourth and fifth portions, wherein the first and second portions are respectively disposed at opposite sides of the data line, each of the third and fourth portions is connected to the first and second portions, and the fifth portion connects the second portions with a next first portion.

4. The method according to claim 3, wherein the pixel electrode partially overlaps the first, second and fifth portions of the one of the common lines.

5. The method according to claim 1, wherein the liquid crystal display device is driven by one of dot inversion, line inversion, column inversion and frame inversion driving methods.

6. The method according to claim 1, wherein the liquid crystal display device is driven with a normally white mode in which light is not transmitted when voltages are not applied.

7. A method of driving a liquid crystal display device, which includes first and second substrates, first and second gate lines on the first substrate, a data line crossing the first and second gate lines to define first and second pixel regions, first and second thin film transistors connected to the first gate line and the data line and to the second gate line and the data line, respectively, first and second common lines alternating the first and second gate lines, first and second pixel electrodes in the first and second pixel regions, respectively and overlapping the first and second common lines, respectively, and a common electrode on the second substrate, the method comprising:

sequentially applying scanning signals to the first and second gate lines;

applying data signals to the data line to supply the first and second pixel electrodes with pixel voltages;

applying a common voltage to the common electrode; and applying a storage capacitor voltage to the first and second common lines, wherein the pixel voltage and the storage capacitor voltage are alternating current voltages having positive and negative polarities alternately with respect to the common voltage, wherein the storage capacitor voltage applied to the first common line has a same polarity as the storage capacitor voltage applied to the second common line, wherein in one of the pixel regions, the pixel electrode short-circuits with a corresponding common line, and the storage capacitor voltage is applied to the short-circuited pixel electrode, and wherein the one of the pixel regions has different black color purity from others of the pixel regions when a black image is displayed and the one of the pixel regions becomes a dark defect, and wherein the pixel voltage is always higher than the storage capacitor voltage with respect to the common voltage when they both are in positive polarities and the pixel voltage is always lower than the storage capacitor voltage with respect to the common voltage when they both are in negative polarities.

8. The method according to claim 7, wherein the storage capacitor voltage has a same period and a same polarity as the pixel voltage.

9. The method according to claim 7, wherein each of the first and second common lines includes first, second, third, fourth and fifth portions, wherein the first and second portions are respectively disposed at opposite sides of the data line, each of the third and fourth portions is connected to the first and second portions, and the fifth portion connects the second portions with a next first portion.

10. The method according to claim 9, wherein the first and second pixel electrodes partially overlap the first, second and fifth portions of the first and second common lines, respectively.

11. The method according to claim 7, wherein the liquid crystal display device is driven by one of dot inversion, line inversion, column inversion and frame inversion driving methods.

12. The method according to claim 7, wherein the liquid crystal display device is driven with a normally white mode in which light is not transmitted when voltages are not applied.

* * * * *